US011357700B2

(12) United States Patent
Bouthiette

(10) Patent No.: US 11,357,700 B2
(45) Date of Patent: Jun. 14, 2022

(54) WIRELESS MEDICATION BLISTER PACK SYSTEM AND BLISTER PACK ATTACHMENT

(71) Applicant: 9155-0020 Quebec Inc., Granby (CA)

(72) Inventor: Etienne Bouthiette, Sainte-Brigitte-de-Laval (CA)

(73) Assignee: 9155-0020 Quebec Inc., Granby (CA)

( * ) Notice: Subject to any disclaimer, the term of this patent is extended or adjusted under 35 U.S.C. 154(b) by 90 days.

(21) Appl. No.: 16/808,829

(22) Filed: Mar. 4, 2020

(65) Prior Publication Data

US 2021/0275396 A1 Sep. 9, 2021

(51) Int. Cl.
*A61J 1/03* (2006.01)
*H01R 12/72* (2011.01)

(52) U.S. Cl.
CPC ..... *A61J 1/035* (2013.01); *H01R 12/721* (2013.01); *A61J 2200/30* (2013.01)

(58) Field of Classification Search
CPC ..... A61J 1/035; A61J 2200/30; H01R 12/721
USPC ..... 206/461, 528
See application file for complete search history.

(56) References Cited

U.S. PATENT DOCUMENTS

2015/0352010 A1* 12/2015 Simpson ..... B65D 75/54 206/534
2017/0248401 A1* 8/2017 Isom ..... A61J 7/0481
2017/0283151 A1 10/2017 Stormer et al.

* cited by examiner

*Primary Examiner* — Rafael A Ortiz
(74) *Attorney, Agent, or Firm* — Hall Estill Law Firm

(57) ABSTRACT

The present disclosure relates to wireless medication blister pack assembly and to a blister pack attachment to be secured to a blister pack assembly. The attachment an electronic card housing for receiving an electronic card which includes electronic components such as card connectors, and a locking system which is configurable between a locked configuration and a releasing configuration. In the locked configuration, the blister pack assembly and the electronic card are connected, with sheet connectors provided on the blister pack assembly and the card connectors being in electronic communication. Such electronic communication allows the electronic components to detect whether a given blister has been detached from the blister pack assembly. In the releasing configuration, the electronic card and the blister pack assembly can be removed from the blister pack attachment, so as to allow the electronic card to be reused with a replacement blister pack assembly.

18 Claims, 7 Drawing Sheets

WIRELESS MEDICATION BLISTER PACK SYSTEM AND BLISTER PACK ATTACHMENT

TECHNICAL FIELD

The present description relates to wireless medication blister pack assemblies and to associated systems and methods. More particularly, the present disclosure relates to a reusable blister pack attachment to be secured to a wireless blister pack assembly.

BACKGROUND

Patients may be prescribed multiple medications to treat various conditions. Some patients need to manage a regimen involving these multiple medications. Available medication management solutions include wireless (or "connected") blister packs with integrated electric traces and electronic components. Such solutions are capable of detecting whether a blister has been detached or opened from the wireless blister pack assembly.

These solutions, however, present some drawbacks. Existing wireless medication blister pack assemblies are not suitable to be re-used, since the electronic components are integral to the blister pack assembly. Such assemblies are therefore very expensive to manufacture and commercialize, and they are no environment friendly, since the entire assembly is discarded once all blisters have been used. Moreover, existing blister pack assemblies are not intended to support such electronic components. When using these solutions, the patients are forced to modify the usual way they are manipulating the blister pack assemblies.

In view of the above, there is therefore a need for an improved wireless medication blister pack system that allows the electronic components to be reused once all blisters have been detached or opened, preferably without affecting the way the blister pack assemblies are being manipulated by the end users.

SUMMARY

It is an object of the present disclosure to provide a wireless medication blister pack system and a blister pack attachment to be secured to a blister pack assembly that overcome or mitigate one or more disadvantages of known medication blister pack systems, or at least provide useful alternatives.

In accordance with an embodiment, there is provided a wireless medication blister pack system comprising: a blister pack assembly comprising: a blister sheet defining a plurality of spaced-apart blisters for receiving medication therein; a sealing sheet for use to seal the blister sheet, the sealing sheet comprising electric traces respectively associated with the blisters and ending in sheet connectors at or near an edge of the sealing sheet, the blisters being detachable, whereby detaching or opening a blister breaks up a corresponding circuit formed by at least one of the electric traces associated with the blister; an electronic card comprising electronic components, including card connectors; and a blister pack attachment comprising an electronic card housing for receiving the electronic card therein, and a locking system configurable between a locked configuration and a releasing configuration, wherein in the locked configuration, the blister pack assembly and the electronic card are connected with the sheet connectors and the card connectors being in electronic communication, allowing the electronic components to detect whether a given blister has been detached from the blister pack assembly or opened; and wherein in the releasing configuration, the electronic card and the blister pack assembly can be removed from the blister pack attachment, allowing the electronic card to be reused.

In accordance with another embodiment, the electronic card comprises an electronic support having an electronic support aperture formed therein, the edge of the sealing sheet being insertable in the electronic support aperture with the sheet connectors extending past the electronic support aperture such that the sheet connectors and the card connectors are electronically connected.

In accordance with a further embodiment, the electronic support further defines an electronic support first side comprising the electronic components, an electronic support second side, and an electronic support upper edge, the card connectors extending from the electronic support first side at or near the electronic support upper edge.

In accordance with yet another embodiment, the electronic card is securable within the electronic card housing.

In accordance with another embodiment, the electronic card is releasably securable within the electronic card housing.

In accordance with a further embodiment, the card connectors are spaced-apart and provided in an alignment adjacent to the electronic support aperture.

In accordance with yet another embodiment, the sheet connectors are spaced-apart and provided in an alignment which corresponds to the longitudinal alignment of the card connectors.

In accordance with another embodiment, the blister pack attachment further comprises a locking frame being coupled to the electronic card housing, the locking frame comprising a connectors compression section configured to apply pressure on both the sheet connectors and the card connectors when the locking system is configured in the locked configuration.

In accordance with a further embodiment, the blister pack attachment further comprises a compressible strip configured to interface with the upper edge of the sealing sheet when being compressed by the connectors compression section and the electronic card housing when the locking system is configured in the locked configuration.

In accordance with yet another embodiment, the compressible strip extends from the electronic card housing.

In accordance with another embodiment, the compressible strip is made of a resilient material.

In accordance with a further embodiment, the electronic card housing defines a housing first side and a housing second side, and the blister pack attachment further comprises a first arm extending from the connectors compression section and being securable with the housing first side.

In accordance with yet another embodiment, the blister pack attachment further comprises a second arm extending from the connectors compression section and being securable with the housing second side.

In accordance with another embodiment, the electronic card housing defines a housing upper edge and the locking frame defines a locking frame longitudinal edge being pivotally coupled to the housing upper edge.

In accordance with a further embodiment, the first arm defines a first arm locking end, and the blister pack attachment further comprises a first pinching finger extending from the first arm about the first arm locking end and being securable with the housing first side to provide the locking system in the locked configuration.

In accordance with yet another embodiment, second arm defines a second arm locking end opposite the locking frame longitudinal edge, and the blister pack attachment further comprises a second pinching finger extending from the second arm about the second arm locking end and being securable with the housing second side to provide the locking system in the locked configuration.

In accordance with another embodiment, the electronic card housing defines a housing outer surface, a housing inner surface opposite the housing outer surface and housing sidewalls joining the housing outer surface and the housing inner surface, and each one of the first and the second pinching fingers comprises a housing sidewall interface perpendicularly extending from a surface of the locking frame for interfacing with one of the housing sidewalls when the locking system is configured in the locked configuration.

In accordance with a further embodiment, each one of the first and the second pinching fingers further comprises a housing outer surface interface perpendicularly extending from the housing sidewall interface for interfacing with the housing outer surface when the locking system is configured in the locked configuration.

In accordance with yet another embodiment, the first arm and the second arm and/or the first pinching finger and the second pinching finger are made from a resilient material allowing the first arm and the second arm and/or the first pinching finger and the second pinching finger to deform when the locking system is provided between the releasing configuration and the locked configuration.

In accordance with another embodiment, the electronic support further comprises spaced-apart electronic card apertures formed therein and configured to secure the electronic card within the electronic card housing.

In accordance with a further embodiment, the electronic card housing further comprises spaced-apart electronic card securing members upwardly extending from the housing inner surface and being insertable within the spaced-apart electronic card apertures and securable therewith.

In accordance with yet another embodiment, each one of the space-apart electronic card securing members comprises an electronic card supporting member upwardly extending from the housing inner surface, and a locking pin upwardly extending from the electronic card supporting member and being insertable within a respective one of the spaced-apart electronic card apertures to lock the electronic support with the electronic card housing.

In accordance with another embodiment, the blister pack assembly further comprises spaced-apart alignment apertures in alignment with the spaced-apart electronic card apertures and the space-apart electronic card securing members when the locking system is configured in the locked configuration.

In accordance with a further embodiment, the space-apart electronic card securing members are inserted in the spaced-apart alignment apertures when the locking system is configured in the locked configuration.

In accordance with yet another embodiment, the locking frame defines a locking frame opening for providing visual access to an upper section of the sealing sheet when the locking system is configured in the locked configuration.

In accordance with another embodiment, the sealing sheet comprises: a printable top layer having a printable top layer upper side and a printable top layer bottom side; an electric traces layer comprising the electric traces and having an electric traces layer upper side being affixed, or affixable, to the printable top layer bottom side and an electric traces layer bottom side being partly covered with a pressure-sensitive adhesive material; and a cover pieces detachable layer having a detachable layer upper side being detachably affixed to the electric traces layer bottom side by means of the pressure-sensitive adhesive material, the cover pieces detachable layer being peelable from the electric traces layer bottom side to allow fixation of the sealing sheet onto a top surface of the blister sheet for closing the blisters defined therein.

In accordance with a further embodiment, the cover pieces detachable layer has tearing lines punched thereon to leave parts of the cover pieces detachable layer affixed onto the electric traces layer bottom side in the form of a number of bottom pieces equal to the given number of blisters and in alignment therewith, the bottom pieces thus preventing any medication stored in the blisters from coming into contact with the adhesive material.

In accordance with yet another embodiment, the electric traces extend from the electric traces layer upper side with the sheet connectors being provided at or near a connector edge of the electric traces layer.

In accordance with another embodiment, the connector edge extends past a printable layer edge of the printable top layer so that the sheet connectors are accessible for electronic communication with the card connectors.

In accordance with a further embodiment, the electronic components further comprise a wireless transceiver and a power module in electric communication with the wireless transceiver.

In accordance with yet another embodiment, at least one of the electronic card and the blister pack attachment further comprises a blister pack status indicator to provide indication to whether a given blister has been detached from the blister pack assembly and/or to provide general information regarding the electronic components of the electronic card.

In accordance with another embodiment, the system further comprises a hub in wireless communication with the wireless transceiver to receive the information in the event where a given blister has been detached from the blister pack assembly.

In accordance with a further embodiment, the wireless communication is provided by Wi-Fi, Bluetooth, Bluetooth Low-energy (BLE) or Long Range narrow band Radio Technology (e.g., LoRa).

In accordance with yet another embodiment, the locking frame is slidably coupled to the electronic card housing.

In accordance with another embodiment, there is provided a blister pack attachment for securing to a blister pack assembly comprising a blister sheet defining a plurality of spaced-apart blisters for receiving medication therein, a sealing sheet sealing the blister sheet, the sealing sheet comprising electric traces respectively associated with the blisters and ending in sheet connectors at or near an edge of the sealing sheet, the blisters being detachable or openable, whereby detaching or opening a blister breaks up a corresponding circuit formed by at least one of the electric traces associated with the blister, the blister pack attachment comprising: an electronic card housing; an electronic card received within the electronic card housing, the electronic card comprising electronic components, including card connectors; and a locking system configurable between a locked configuration and a releasing configuration, wherein in the locked configuration, the blister pack assembly and the electronic card are connectable with the sheet connectors and the card connectors capable of being in electronic communication, allowing the electronic components to detect whether a given blister has been detached from the blister pack assembly or opened; and wherein in the releasing configuration, the electronic card and the blister pack assembly are removable from the blister pack attachment, allowing the electronic card to be reused.

In accordance with a further embodiment, there is provided a blister pack attachment for securing to a blister pack assembly comprising a blister sheet defining a plurality of spaced-apart blisters for receiving medication therein, a sealing sheet sealing the blister sheet, the sealing sheet comprising electric traces respectively associated with the blisters and ending in sheet connectors at or near an edge of the sealing sheet, the blisters being detachable or openable, whereby detaching or opening a blister breaks up a corresponding circuit formed by at least one of the electric traces associated with the blister, the blister pack attachment comprising: an electronic card housing for receiving an electronic card therein comprising electronic components, including card connectors; and a locking system configurable between a locked configuration and a releasing configuration, wherein in the locked configuration, the blister pack assembly and the electronic card are connectable with the sheet connectors and the card connectors capable of being in electronic communication, allowing the electronic components to detect whether a given blister has been detached from the blister pack assembly or opened; and wherein in the releasing configuration, the electronic card and the blister pack assembly are removable from the blister pack attachment, allowing the electronic card to be reused.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
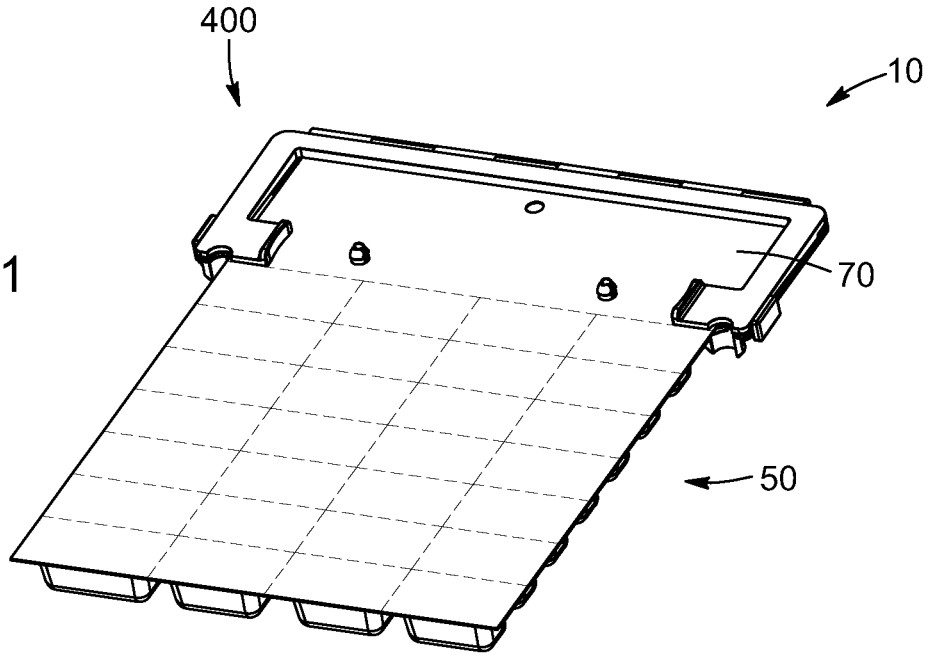
FIG. 1 is a partial top perspective view of a wireless medication blister pack system in accordance with an embodiment. The wireless medication blister pack system includes a blister pack assembly and a blister pack attachment which is secured to the blister pack assembly, the blister pack attachment being configured in a locked configuration.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", "mounted" and "mountable" or "secured" and "securable" may be interchangeable, in that the present wireless medication blister pack system or blister pack attachment also relate to kits with corresponding components for assembling a resulting fully-assembled and fully-operational wireless medication blister pack system or blister pack attachment.

Furthermore, although the present wireless medication blister pack system is described as being used with medication or pills, a person skilled in the art to which the wireless medication blister pack system pertains would understand that it can be used with various objects. For this reason, expressions such as "pill", "medicine", "tablet", "medication", "pharmacist", "prescription", "pharmacy", etc. as used herein should not be taken to limit the scope of the present description to blister pack systems or assemblies suitable for medication.

Moreover, components of the present wireless medication blister pack system, blister pack attachment and/or steps of the method(s) described herein could be modified, simplified, altered, omitted and/or interchanged, without departing from the scope of the present disclosure, depending on the particular applications which the present wireless medication blister pack system or blister pack attachment is intended for, and the desired end results, as briefly exemplified herein and as also apparent to a person skilled in the art.

In addition, although the embodiments as illustrated in the accompanying drawings comprise various components, and although the embodiments of the present wireless medication blister pack system or blister pack attachment and corresponding portion(s)/part(s)/component(s) as shown consist of certain geometrical configurations, as explained and illustrated herein, not all of these components and geometries are essential and thus should not be taken in their restrictive sense, i.e., should not be taken so as to limit the scope of the present disclosure. It is to be understood, as also apparent to a person skilled in the art, that other suitable components and cooperation thereinbetween, as well as other suitable geometrical configurations may be used for the present wireless medication blister pack system or blister pack attachment and corresponding portion(s)/part(s)/component(s) according to the wireless medication blister pack system or blister pack attachment, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

There is a need for an improved wireless medication blister pack system that allows electronic components (e.g., wireless transceiver and/or card connectors) to be reused once a blister sheet and a sealing sheet which seals the blister sheet have been permanently damaged upon detachment of a respective blister and which, by virtue of its design and components, would be able to overcome or at least minimize some of the above-discussed concerns.

Accordingly, the present disclosure describes wireless medication blister pack systems and, more particularly, reusable blister pack attachments to be releasably secured to blister pack assemblies.

Figure 2:
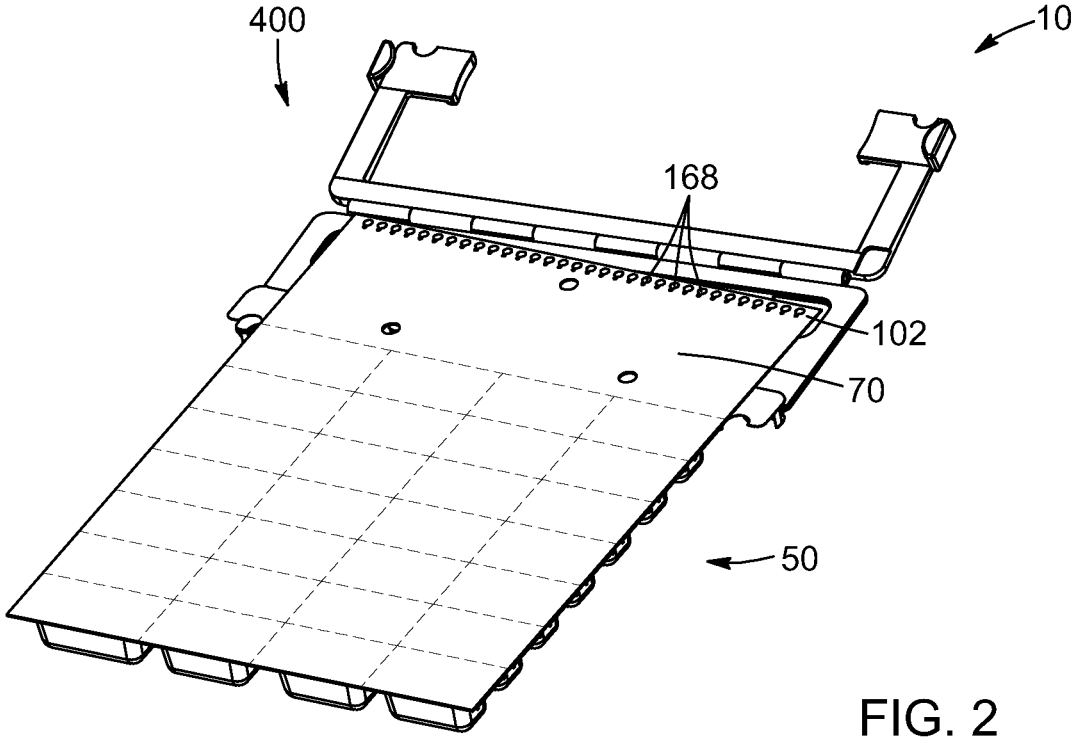
FIG. 2 is a partial top perspective view of the wireless medication blister pack system of FIG. 1, the blister pack attachment being configured in a releasing configuration.

Referring now to the drawings and more particularly to the non-limitative embodiment of FIGS. 1 and 2, a wireless medication blister pack system (10) is shown. The wireless medication blister pack system (10) includes a blister pack assembly (50) for storing medications therein so as to be dispensed to a patient, an electronic card (300), as well as a blister pack attachment or blister pack contactor (400), as it will be described in more details below.

Figure 3:
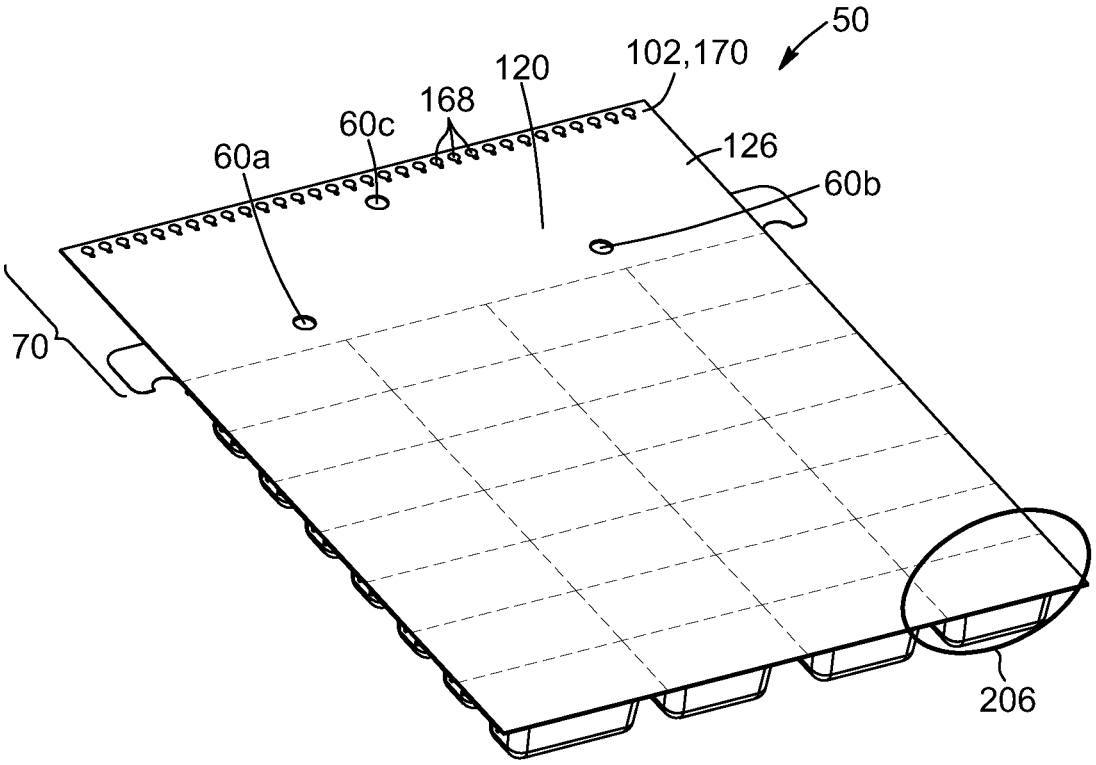
FIG. 3 is a top perspective view of the blister pack assembly of FIGS. 1 and 2.
Figure 4:
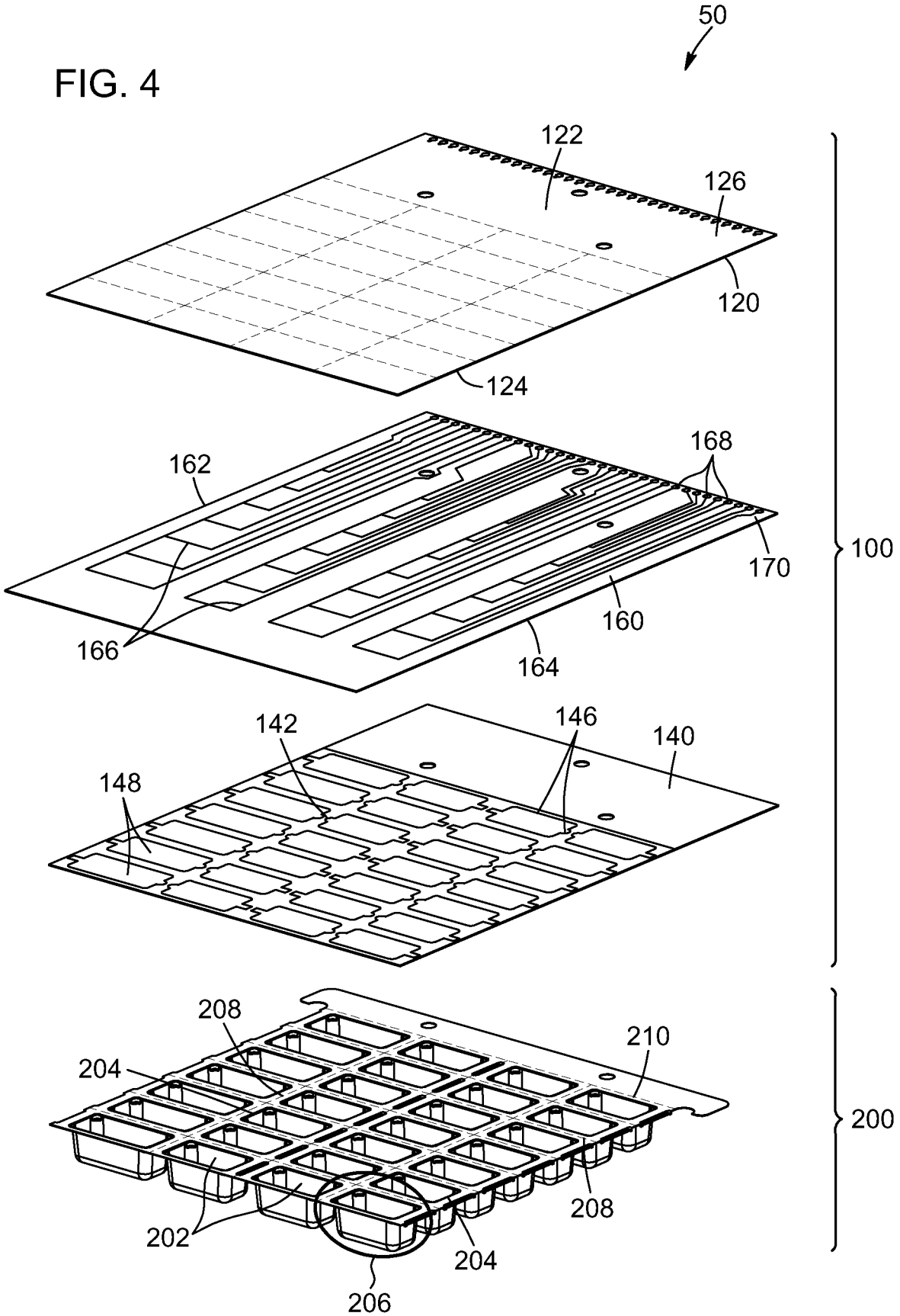
FIG. 4 is an exploded top perspective view of the blister pack assembly of FIG. 3, the blister pack assembly comprising a blister sheet and a sealing sheet, which includes a printable top layer, an electric traces layer and a cover pieces detachable layer.
Figure 5:
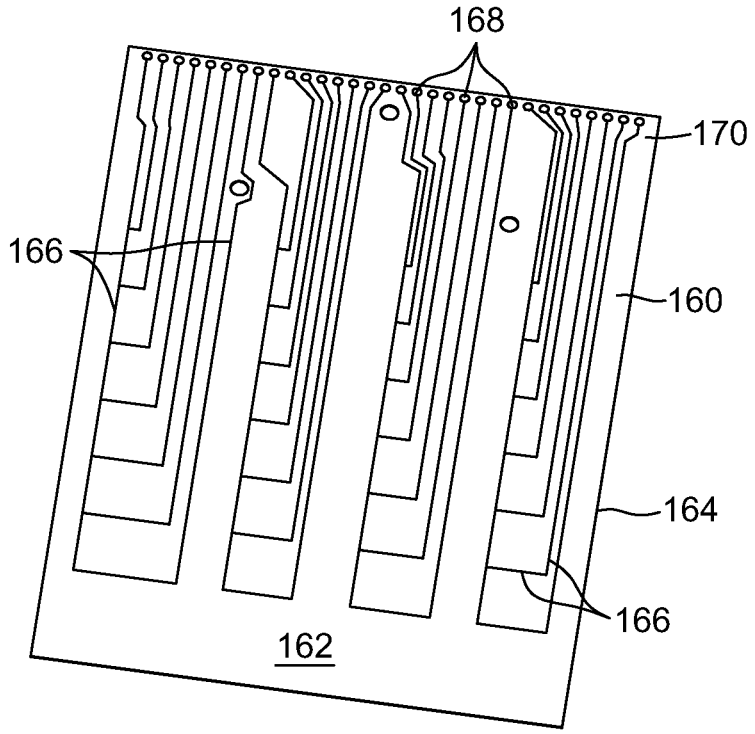
FIG. 5 is a top perspective view of the electric traces layer of FIG. 4.

Referring now more particularly to the non-limitative embodiment of FIGS. 3 to 5, the blister pack assembly (50) includes a blister sheet or container defining sheet (200), which defines a plurality of spaced-apart blisters (206) which are shaped, sized and configured so as to receive medication therein, and a sealing sheet (100), which is used to seal the blister sheet (200). As well known by a person skilled in the art to which the blister pack assembly (50) pertains, medication can take the form of pills, tablets, capsules, vitamins, supplements, powders, creams, placebo, any form of liquid, gel or solid medication, which can come in different sizes, weights, configurations and shapes. In the present description, the term "medication" is used, and is meant to encompass any of these types of medication.

As best shown in FIG. 4, the blister sheet (200) includes a plurality of opened top containers (202) which are surrounded by a container flange (204) configured to be sealed with the sealing sheet (100). The blister sheet (200) further includes tearing lines (146) so as to make it possible to detach each of the blisters (206) comprising a single container from its adjacent blister(s) (206).

Still referring to the non-limitative embodiment of FIGS. 3 to 5, the sealing sheet (100) includes electric traces or conducting traces (166), which are respectively associated with the blisters (206) and which end in sheet connectors (168) at (i.e., near) an edge (102) of the sealing sheet (100). As it will be described in more details below, the blisters (206) are detachable such that detaching or opening a blister (206) breaks up a corresponding circuit formed by an electric trace (166) or a plurality of electric traces (166) which is/are associated with the blister (206).

As best shown in FIG. 4, the sealing sheet (100) includes a printable top layer (120) which has a printable top layer upper side (122) and a printable top layer bottom side (124), which is found opposite to the printable top layer upper side (122). The sealing sheet (100) further includes an electric traces layer (160) which includes the electric traces (166). The electric traces layer (160) has an electric traces layer upper side (162) which is affixed, or which is affixable, to the printable top layer bottom side (124) and an electric traces layer bottom side (164), which is partly covered with a pressure-sensitive adhesive material (not shown). The sealing sheet (100) further includes a cover pieces detachable layer (140) which has a detachable layer upper side (142) which is detachably affixed to the electric traces layer bottom side (164) by means of the pressure-sensitive adhesive material. As known by a person skilled in the art to which the sealing sheet (100) pertains, the cover pieces detachable layer (140) is peelable (i.e., detachable) from the electric traces layer bottom side (164) so as to allow fixation of the sealing sheet (100) onto a top surface (210) defined by the blister sheet (200) for closing the blisters (206) defined therein.

In a non-limitative embodiment, the cover pieces detachable layer (140) has tearing lines (146) punched thereon to leave parts of the cover pieces detachable layer (140) affixed onto the electric traces layer bottom side (164) in the form of a number of bottom or cover pieces (148) equal to the given number of blisters (206) and in alignment therewith. The bottom or cover pieces (148) thus prevent any medication stored in the blisters (206) from coming into contact with the adhesive material. The printable top layer (120) and the electric traces layer (160) also includes tearing lines punched therein in such a manner and position as to be in line with the tearing lines (146) of the cover pieces detachable layer (140) and the tearing lines (208) of the blister sheet (200) so that a respective blister (206) can be detached from its adjacent blister(s) (206) in a way to break up the circuit formed by the respective electric trace(s) (166) which is/are associated with such blister (206).

A person skilled in the art to which the blister pack assembly (50) (i.e., blister sheet (200) and sealing sheet (100)) pertains would, however, understand that the blister pack assembly (50), the sealing sheet (100), the printable top layer (120), the cover pieces detachable layer (140), the electric traces layer (160) and/or the blister sheet 200 can take any shape, size or configuration as long as it provides the sheet connectors (168) to be accessible for electronic communication with the blister pack attachment (400) or electronic card (300), as it will be described in more details below.

As shown in the non-limitative embodiment of FIGS. 3 to 5, the electric traces (166) extend from the electric traces layer upper side (162) with the sheet connectors (168) being provided at (i.e., near) a connector edge (170) of the electric traces layer (160). A person skilled in the are to which the sealing sheet (100) or the electric traces layer (160) pertains would, however, understand that the electric traces (166) can alternatively extend from the electric traces layer bottom side (164), from the printable top layer upper side (122) or from the printable top layer bottom side (124) as long as the sheet connectors (168) remain accessible to the blister pack attachment (400) or to the electronic card (300) for electronic communication therewith. As best shown in FIG. 3, the connector edge (170) extends past a printable layer edge (126) defined by the printable top layer (120) so that the sheet connectors (168) remain accessible for electronic communication with the card connectors (320) (FIG. 7).

Figure 6:
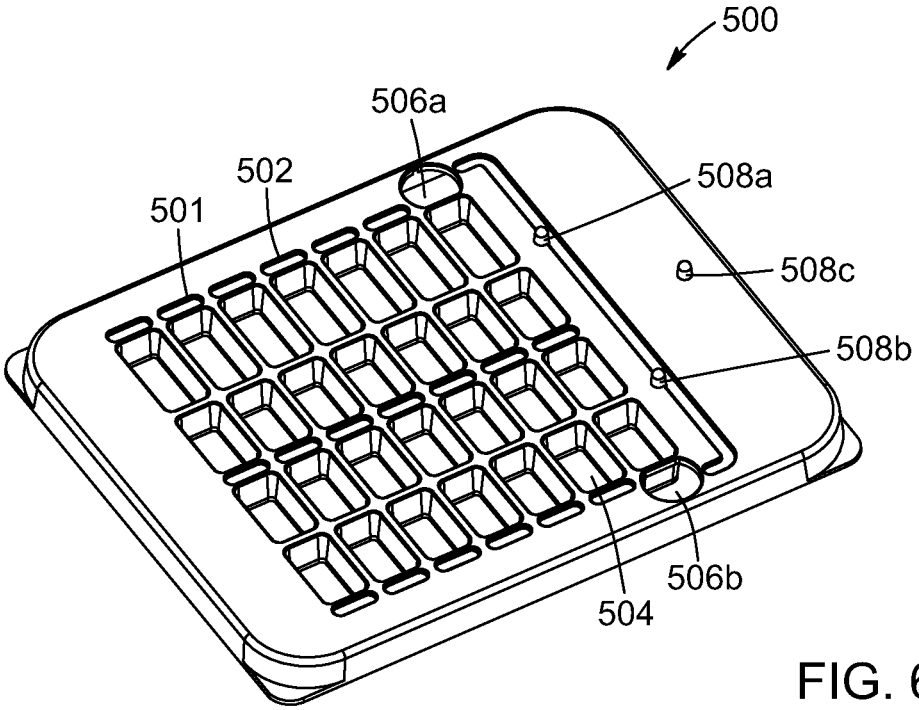
FIG. 6 is a top perspective view of blister pack assembly support which is configured to support the blister sheet therein.

Now referring more particularly to FIG. 6, there is shown a blister pack assembly support (500). The purpose of the blister pack assembly support (500) is to receive, hold and support one or more of the blister sheet (200). The blister pack assembly support (500) includes a main support (501) which defines a support top surface (502), and a plurality of recesses or containers (504) formed therein that are equal in number to the containers (202) embossed on the blister sheet (200). The recesses or containers (504) are positioned, shaped and sized so as to receive the containers (202), preventing displacement of the blister sheet (200) relative to the main support (501) while the blister sheet (200) is filled with the pills. In the illustrated non-limitative embodiment, the blister pack assembly support (500) also includes a pair of apertures (506*a*, 506*b*), which are formed in the main support (501) and which are located on opposite sides of the support top surface (502), allowing the user (e.g., the pharmacist or the caregiver) to insert his/her fingers below the blister sheet (200) so as to facilitate removal of the blister pack assembly (50) once the blister sheet (200) has been sealed with the sealing sheet (100).

The blister pack assembly support (500) further includes pin-like members (508*a*, 508*b*, 508*c*) which upwardly extends from the top surface of an upper section of the main support (501). As will be described in more details below, the pin-like members (508*a*, 508*b*, 508*c*) can be shaped, sized and configured so as to be inserted in corresponding spaced-apart alignment apertures (60*a*, 60*b*, 60*c*) defined by the blister pack assembly (50) (FIG. 3). The spaced-apart alignment apertures (60*a*, 60*b*, 60*c*) can therefore cooperate with the pin-like members (508*a*, 508*b*, 508*c*) in order to ensure proper positioning of the sealing sheet (100) during installation and exact superposition of the cover pieces (148) of the sealing sheet (100) with the corresponding cavities or containers (202), as well as exact superposition of the tearing lines of the sealing sheet (100), which needs to be in alignment with the tearing lines (208) of the blister sheet (200), so as to form a perfectly sealed blister pack assembly (50) with the medication being enclosed therein. The blister pack assembly support (500) can be made of a substantially rigid plastic material or any other suitable material, while the blister sheet (200) can be made of a more flexible or resilient plastic material or any other suitable material.

Figure 7:
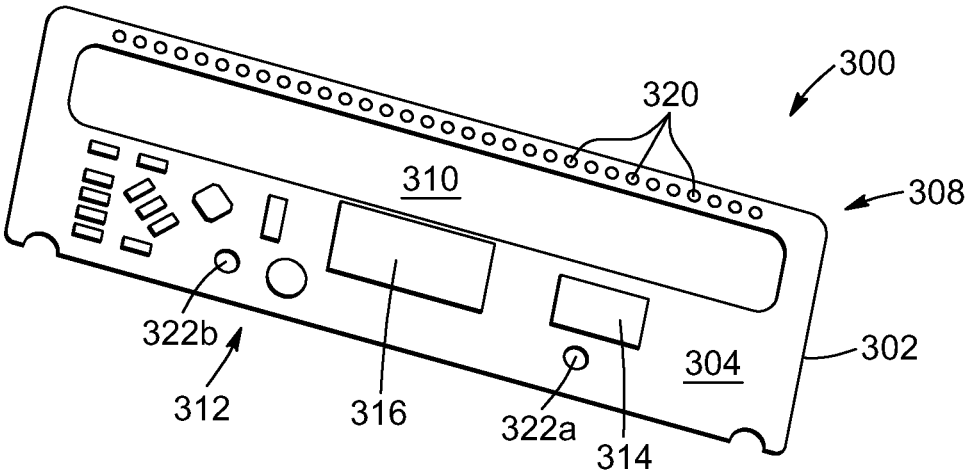
FIG. 7 is a top perspective view of an electronic support first side of an electronic card.
Figure 8:
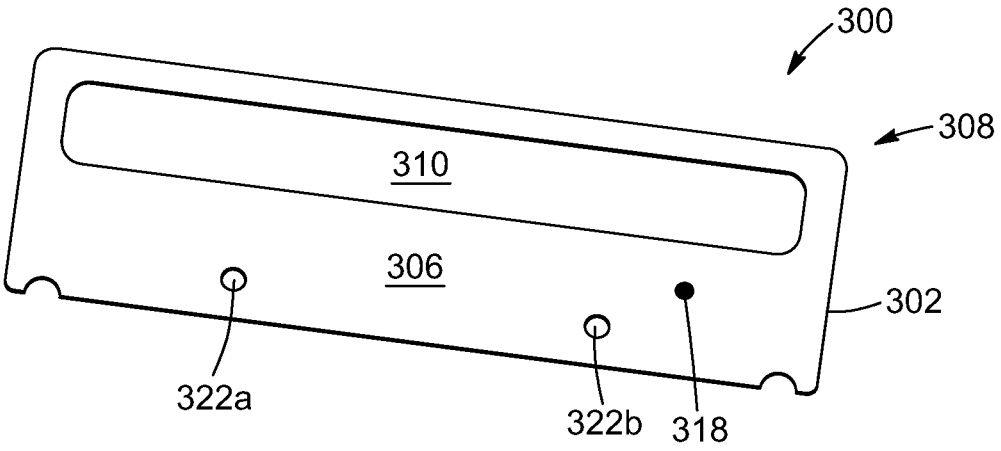
FIG. 8 is a top perspective view of an electronic support second side of the electronic card.

Now referring more particularly to the non-limitative embodiment of FIGS. 7 and 8, there is provided an electronic card (300). The electronic card (300) includes electronic components (312), such as a wireless transceiver (314) (e.g., Wi-Fi, Bluetooth, Bluetooth Low-energy (BLE), Long Range narrow band Radio Technology (e.g., LoRa)), card connectors (320) and a power module (316), which is in electric communication with the wireless transceiver (314). Other electronic components can be provided on the electronic card (300), such as, without limitations, a memory, a microcontroller, a real-time clock, and the like. The electronic card (300) further includes an electronic support (302) which defines an electronic support aperture (310) formed therein. The edge (102) of the sealing sheet (100), and more particularly the connector edge (170) of the electric traces layer (160), is therefore insertable in the electronic support aperture (310) with the sheet connectors (168) which extend past the electronic support aperture (310) such that the sheet connectors (168) and the card connectors (320) can electrically be connected. The electronic support (302) further defines an electronic support first side (304), which comprises the electronic components (312), an electronic support second side (306), which is found opposite to the electronic support first side (304), as well as an electronic support upper edge (308). In the embodiment illustrated, the first side of the card (300) is hidden when in the attachment (400) (shown in FIGS. 9 and 10), and the second side (306) is exposed and faces outwardly relative to the attachment, when in use. As best shown in FIG. 7, the card connectors (320) extend from the electronic support first side (304) at (i.e., near) the electronic support upper edge (308).

Still referring to the non-limitative embodiment shown in FIGS. 7 and 8, the electronic support (302) further includes spaced-apart electronic card apertures (322*a*, 322*b*) formed therein. The electronic card apertures (322*a*, 322*b*) are shaped, sized and configured so as to secure, and more particularly to releasably secure, the electronic card (300) within or to the electronic card housing (410).

Figure 9:
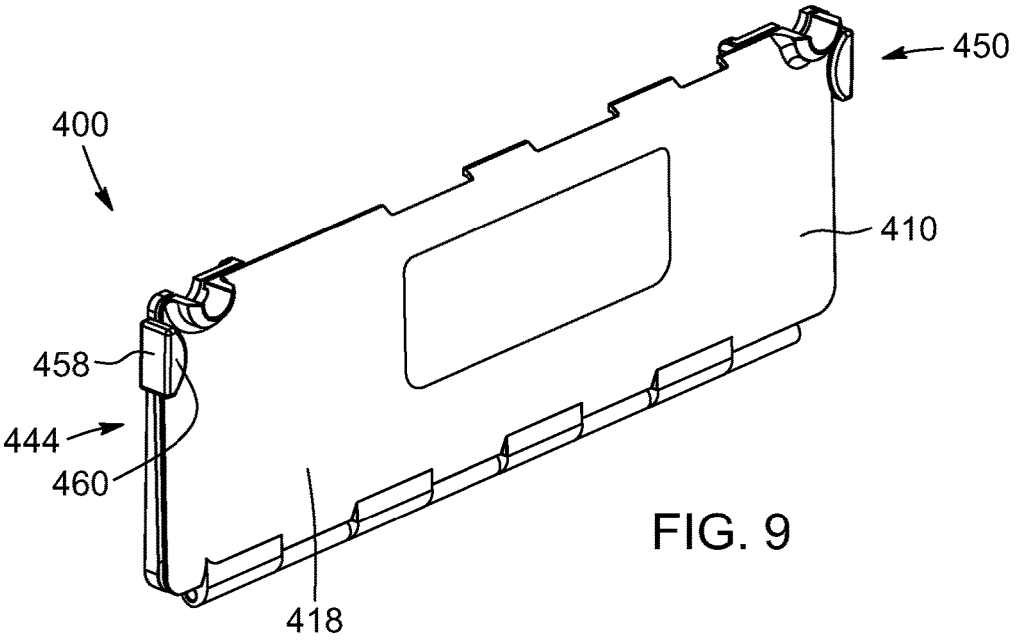
FIG. 9 is a bottom perspective view of the blister pack attachment of FIG. 1, the blister pack attachment being configured in the locked configuration.
Figure 10:
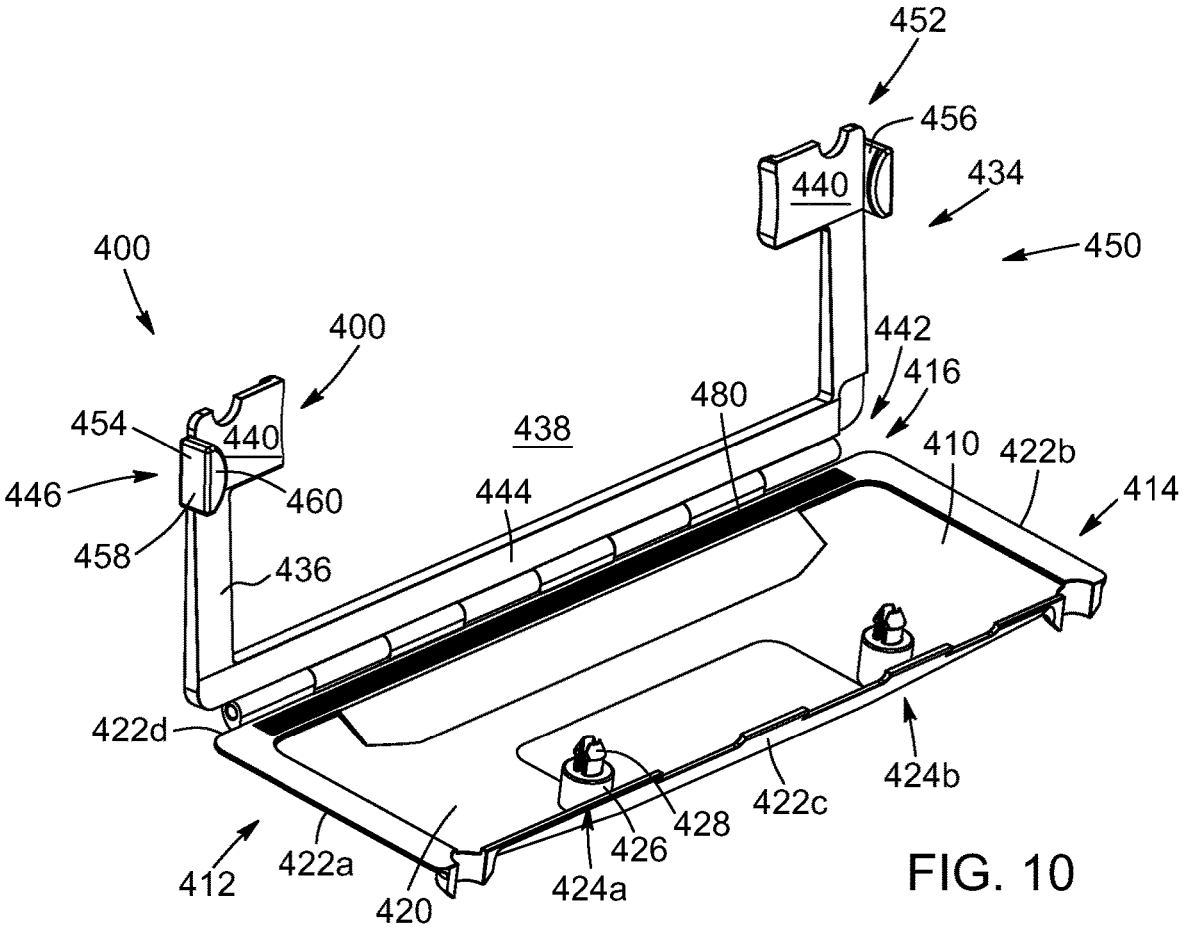
FIG. 10 is a top perspective view of the blister pack attachment of FIG. 2, the blister pack attachment being configured in the releasing configuration.
Figure 11:
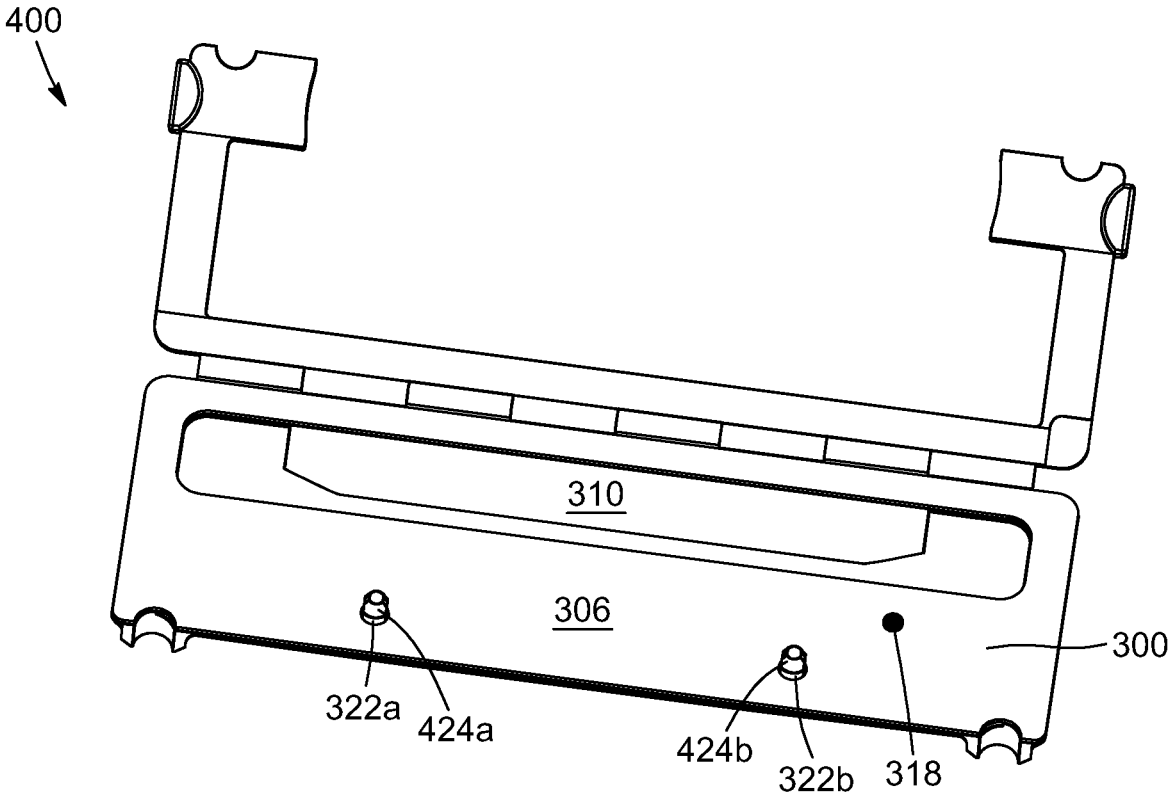
FIG. 11 is a top perspective view of the blister pack attachment of FIG. 10, which includes an electronic card housing for receiving the electronic card therein.

Now referring more particularly to the non-limitative embodiment of FIGS. 9 and 10, the blister pack attachment (400) includes the electronic card housing (410), which is shaped, sized and configured to receive, and more particularly to releasably receive, the electronic card (300) therein. The blister pack attachment (400) further includes a locking system (434) which is configurable between a locked configuration (FIGS. 1 and 9) and a releasing configuration (FIGS. 2 and 10). When the locking system (434) of the blister pack attachment (400) is configured in the locked configuration, the blister pack assembly (50) and the electronic card (400) are connected, allowing the sheet connectors (168) and the card connectors (320) to be in electronic communication, so as to allow the electronic components (312) to detect whether a given blister (206) has been detached from the blister pack assembly (50), or alternatively, opened. On the other hand, when the locking system (434) is configured in the releasing configuration (FIG. 10), the blister pack assembly (50), and optionally the electronic card (300), can be removed from the blister pack attachment (400) (FIG. 2), so as to allow the blister pack attachment (400), and therefore the electronic card (300), to be reused with another (a replacement) blister pack assembly (50).

As best shown in the non-limitative embodiments of FIGS. 3, 5 and 7, the card connectors (320) are spaced-apart and are provided along a longitudinal axis adjacent to (i.e., above) the electronic support aperture (310). On the other hand, the sheet connectors (168) are spaced-apart and are provided along a longitudinal axis at (i.e., near) the edge (102) of the sealing sheet (100). The sheet connectors (168) provided on the sealing sheet (100) are arranged and positioned relative to the card connectors (320) provided on the electronic card (300), or alternatively elsewhere on the blister pack attachment (400), so that when the locking system (434) is provided in the locked configuration, each one of the sheet connectors (168) is facing a respective one of the card connectors (320) and is being in electronic communication therewith.

Still referring to the non-limitative embodiment of FIGS. 9 and 10, the electronic card housing (410) defines a housing first side (412) and a housing second side (414), which is found opposite to the housing first side (412). The electronic card housing (410) further defines a housing upper edge (416), a housing outer surface (418), a housing inner surface (420), which is found opposite to the housing outer surface (418), and housing sidewalls (422*a*, 422*b*, 422*c*, 422*d*) which join the housing outer surface (418) and the housing inner surface (420) together.

Still referring to the non-limitative embodiment of FIGS. 9 and 10, the electronic card housing (410) further includes spaced-apart electronic card members (424*a*, 424*b*) or blister pack positioning guides, which upwardly extend from the housing inner surface (420). The members (424*a*, 424*b*) could also act as securing members, but in the embodiment illustrated, they mainly allow aligning the electronic card 300 with the blister pack assembly 50. The electronic card members (424*a*, 424*b*) are insertable within the electronic card apertures (322*a*, 322*b*). Optionally, they can also be securable therewith so as to lock the electronic card (300) with the, or within, the electronic card housing (410).

As best illustrated in FIG. 10, each one of the electronic card members (424*a*, 424*b*) includes an electronic card supporting member (426) which upwardly extends from the housing inner surface (420), as well as a pin (428) which upwardly extends from the electronic card supporting member (426). The locking and/or alignment pin (428) is shaped, sized and configured so as to be inserted within a respective one of the electronic card apertures (322*a*, 322*b*) so as to lock or align the electronic support (302) with or within the electronic card housing (410). Since the locking system can be provided in the locking configuration, it may not be needed to lock the electronic card (300) to the electronic card housing (400), but at least align them one with other. The electronic card members (424*a*, 424*b*) can therefore be used to align the electronic card (300) as required within the electronic card housing (410) (i.e., no need to lock it with the electronic card housing (410)), such that the electronic contacts of the assembly (50) come into proper contact with the electronic contacts of the card (300), when secured by the attachment (400).

The alignment apertures (60*a*, 60*b*) of the blister pack assembly (50) can also be brought in alignment with the electronic card apertures (322*a*, 322*b*) and the electronic card members (424*a*, 424*b*) when the blister pack attachment (400) is positioned relative to the blister pack assembly (50) and the locking system (434) is provided in its locked configuration (FIG. 1), which helps in easily aligning the sheets connectors (168) of the blister pack assembly (50) with the card connectors (320) extending from the electronic support first side (302) of the electronic card (300). Indeed, the electronic card members (424*a*, 424*b*) are inserted in the alignment apertures (60*a*, 60*b*) when the locking system (434) is configured in the locked configuration and the blister pack attachment (400) is secured to the blister pack assembly (50).

Referring more particularly to the non-limitative embodiment of FIGS. 9 and 10, the blister pack attachment (400), so as to provide the locking system (434), includes a locking frame (436) which is coupled to the electronic card housing (410). The locking frame (436) includes a connectors compression section (444), which is shaped, sized and configured to apply pressure on both the sheet connectors (168) and the card connectors (320) when the locking system (434) is configured in the locked configuration and the blister pack attachment (400) is secured with the blister pack assembly (50)(FIG. 1). A suitable electronic communication can therefore be provided from the electric traces (166) to the sheet connectors (170), and the card connectors (320).

Still referring to the non-limitative embodiment of FIGS. 9 and 10, the locking frame (436) further includes a first arm (446) which extends from the connectors compression section (444). The first arm (446) is shaped, sized and configured so as to be securable with the housing first side (412). The locking frame (436) further includes a second arm (450) which also extends from the connectors compression section (444). The second arm (450) is shaped, sized and configured so as to be securable with the housing second side (414). The locking frame (436) also defines a locking frame longitudinal edge (442) which is pivotally coupled to the housing upper edge (416). The first arm (446) defines a first arm locking end (448), while the second arm (450) defines a second arm locking end (452). The blister pack attachment or contactor (400) further includes a first pinching finger (454) which extends from the first arm (446) about the first arm locking end (448). The first pinching finger (454) is shaped, sized and configured so as to be securable with the housing first side (412). On the other hand, the blister pack attachment (400) further includes a second pinching finger (456) which extends from the second arm (450) about the second arm locking end (452). Similarly, the second pinching finger (456) is shaped, sized and configured so as to be securable with the housing second side (414) so as to configure the locking system in the locked configuration (FIGS. 1 and 9).

Each one of the first and the second pinching fingers (454, 456) includes a housing sidewall interface (458) which perpendicularly extends from a surface (440) defined by the locking frame (436). The housing sidewall interfaces (458) of the first and second pinching fingers (454, 456) interface with the housing sidewalls (422*a*, 422*b*) when the locking system is configured in the locked configuration. The first and second pinching fingers (454, 456) further includes a housing outer surface interface (460) which perpendicularly extends from the housing sidewall interface (458). The housing outer surface interface (460) of the first and second pinching fingers (454, 456) interfaces with the housing outer surface (418) when the locking system is configured in the locked configuration.

According to a non-limitative embodiment, the first arm (446) and the second arm (450) and/or the first pinching finger (454) and the second pinching finger (456) can be made of a resilient material, such as a resilient plastic material, so as to allow the first and second arms (446, 450) and/or the first and second pinching fingers (454, 456) to deform when the locking system is provided between the releasing configuration and the locked configuration.

Still referring to the non-limitative embodiments of FIGS. 1 and 2, the locking frame (436) of the blister pack attachment (400) defines a locking frame opening (438) for providing visual access to an upper section (70) of the sealing sheet (100) when the locking system (434) is configured in the locked configuration and therefore, when the blister pack attachment (400) is secured to the blister pack assembly (50).

Additionally, in a non-limitative embodiment, and as shown in FIG. 10, the blister pack attachment (400) can further include a compressible strip (480) which is configured to interface with the upper edge (102) of the sealing sheet (100) when being compressed by the electronic support (302), and the connectors compression section (444) of the locking frame (436) when the locking system is configured in the locked configuration. The compressible strip (480) extends from the electronic card housing (410) and can be made of a resilient material such as, without limitation, a rubber-like material, a foam-like material, and the like. A suitable electronic communication can therefore be provided from the electric traces (166) to the sheet connectors (170), and therefore, to the card connectors (320).

A person skilled in the art to which the blister pack attachment or contactor (400) described above pertains would understand that the attachment (400) can take any shape, size and configuration, as long as it allows its attachment to a blister pack assembly, such as the blister pack assembly (50) described above, while providing the sheet connectors (168) in electronic communication with the card connectors (320), allowing the electronic card (300) to be reused, even though the blister pack assembly is permanently damaged.

Indeed, in some implementations, the locking frame (436), instead of being pivotally coupled to the electronic card housing (410), can be slidably coupled to the electronic card housing (410), for example, as long as it allows attachment of the blister pack attachment (400) to a blister pack assembly (50), while providing the sheet connectors (168) in suitable electronic communication with the card connectors (320), so as to allow the electronic card (300) to be reused.

In some implementations, the electronic card (300) can be releasably received within or secured to the blister pack attachment (400), while in some implementations, the electronic components (312) can be integrated with the blister pack attachment (400). In the first scenario, if a component of the electronic card (300) is damaged, the blister pack attachment (400) can still be used with a replacement electronic card (300). For example, the electronic card (300) can be replaced every month, or year, according to the power module capacity. In the second scenario, the whole blister pack attachment (400) would need to be replaced.

According to a non-limitative embodiment, the electronic card (300) and/or a component of the blister pack attachment (400) can further include a blister pack status indicator (318), which could be operatively connected with the respective electronic components (312) so as to provide indication, or alternatively visual, or sound, indicator, of the status of the assembly (50). For example, the electronic card (300) may periodically send indications of the status of the blister of a given assembly (50), either directly to a remote server, or to a hub, node or gateway which relays the blister pack status to a remote server. Based on the blister information received (including for example the number and positions of blisters having been detached or opened), the server can determine whether the actual status of the assembly (50) corresponds to the status in which it should be. For example, the server can determine that a given dose was due four hours ago but wasn't taken. Based on the blister pack information received via an uplink, the remote server can send a downlink to the electronic card (300), such that an indicator on the card notifies an end user (such as the patient or a nurse) that a dose is due. For example, the indicator could be a light that flashes slowly when the dose is due for more than a first period, such as an hour, and flashes rapidly, when the dose is due for more than a second period of time, such as over four hours.

The information can be received by the remote server in real time. For example, the remote server can send a downlink to the electronic card (300) every second, while the electronic card (300) can send an uplink to the remote server only if a given blister has been detached or opened (e.g., every 5 seconds). The remote server can thus confirm every second the status of the blister pack assembly (50). If no blister has been detached or opened, the electronic card (300) can nevertheless send an uplink to the remote server, so the remote server can confirm that the wireless medication blister pack system (10) is still online (i.e., the battery has not been fully consumed yet). For example, the light can flash every time the remote server sends a downlink to the electronic card (300). For example, the light can flash every second, with a first color (e.g., green), if the remote server determines that a given blister (206) has been detached from the blister pack assembly (50), with a second color (e.g., yellow), if the remote server determines that a given blister (206) needs to be detached soon from the blister pack assembly (50), or with a third color (e.g., red), if the remote server determines that a given blister (206) has not been detached from the blister pack assembly (50). In alternate embodiments, other types of indications may be provided, such as whether a given blister (206) has been detached from the blister pack assembly (50) (i.e., from adjacent blister(s) (206)), or opened, and/or to provide general information regarding the electronic components (312) of the electronic card (300) (e.g., battery needs to be charged, sheet connector(s) is/are damaged, and the like). This information can be provided directly to the pharmacist, patient or caregiver, via an application on a wireless or connected device.

The wireless medication blister pack system (10) as defined above typically communicates to remote devices via a hub or gateway, including for example a smart phone or other similar wireless device. The wireless communication can be provided by, without limitation, Wi-Fi, Bluetooth, Bluetooth Low-energy (BLE), Long Range narrow band Radio Technology (e.g., LoRa) and the like.

The wireless medication blister system (10) as described above can be used to store one or more medications to be consumed by a patient at various times throughout the day (e.g., morning, afternoon, evening, bedtime) for a given period of time (e.g., a month or a week). Conventionally, a pharmacist or other caregiver can prepare a sealed blister pack assembly (50) for a patient for the given period (e.g., a week or a month). The pharmacist or other caregiver can then secure the blister pack attachment or contactor (400), with the electronic card (300) secured or releasably secured therein, to the sealed blister pack assembly (50) by configuring the locking system (434) in the locked configuration as described above, and can send it to the patient. The wireless medication blister pack system (10) can therefore be in the patient's home, office or other convenient location, for example. The patient can then detach, or puncture, the respective blisters (206) at the appropriate time to remove the medications contained therein. Accordingly, when the patient detaches the blister (206) from the blister pack assembly (50), the circuit for said given blister is opened, and electronic components of the cards detects the opened circuit and can transmit said information on the status of the blister wirelessly, to remote devices, for further processing, including for example updating the status of the blister pack assembly. The position of the blister pack assembly, the ID or position of opened blisters, and/or time at which a give blister has been opened are example of data that can be transmitted by the electronic card, via the wireless transmitter. As mentioned before, the electronic card may also receive information for remote devices, and modify the status of indicators on the card based on the information received.

In some implementations, a clock can be provided with the electronic card (300) or blister pack attachment (400), so as to record the time of the detachment or puncture. Such information can be stored, for example, in a memory, and, via the wireless transceiver (314), a signal can be sent to the hub or gateway, providing the caregiver with the information that the medication of a respective blister (206) as been taken. Alternatively, the information can be stored, for example, in a memory, and, via a wired connection, via a USB port for example, whereby the information is then transferred to the hub or gateway, providing the caregiver with the information that the medication of a respective blister (206) as been taken. According to this scenario, the medication blister pack system does not necessarily need to include a wireless transceiver to send and receive information on the blister pack assembly. Alternatively, as mentioned above, the signal can be sent periodically, a few times per hour, or more frequently, so as to provide information on the blister pack assembly almost in real time.

As known by a person skilled in the art to which the blister pack assembly (50) pertains, the blister pack assembly (50) (i.e., sealing sheet comprising the printable top layer, the electric traces layer and the cover pieces detachable layer, as well as the blister sheet) are not suitable to be re-used, as the detachment of the blisters (206) from the blister pack assembly (50) renders the sealing sheet (100) and the blister sheet (200) permanently damaged. Thus, the blister pack assembly (50) can be used for one and only one medication regimen (e.g., one week) and needs to be discarded thereafter. The blister pack attachment (400) and electronic card (300), however, can be recycled and re-used with a replacement blister pack assembly (50).

In some implementations, the hub or gateway can receive data relating to the status a blister (206) (opened, detached or punctured) in real time or at a particular time from the wireless transceiver (314). The data that transits via the gateways can be stored locally, for example in a hospital's server, or remotely, in one or more cloud servers. In some implementations, the wireless medication blister pack system (10) can communicate directly with one or more smart mobile devices, via dedicated a dedicated application ("app".)

In some implementations, the operational life of the electronic cards (300) can be several months to more than a year, such that is can be reused for a plurality of blister pack assemblies (50). The attachment (400) is reusable as well. The electronic card (300) can have enough power (e.g., from a battery or solar cell) to get through a patient's yearly drug regimen. When the battery power is low, it can be recharged or changed. The electronic card (300) may also be replaced, while the blister pack attachment (400) can remain usable.

As mentioned above, in some implementations, the electronic card (300) of the blister pack attachment (400) and the hub can communicate with each other through a Wi-Fi connection, a Bluetooth connection, a Bluetooth Low-energy (BLE) connection, or a Long Range narrow band Radio Technology (e.g., LoRa) connection. Other known communication methods can be used. In some implementations, the electronic card (300) and the hub can communicate at a distance of up to approximately 15 meters, 150 meters, 5 kilometers, 10 kilometers, 15 kilometers or 100 kilometers, depending on the surrounding environment (city, countryside), the positioning of the hub, etc.

Typically, the blisters (206) (i.e., the printable top layer (120)) are labeled to be consumed sequentially according to a prescribed medication regimen. For example, a patient's physician can prescribe medications to be consumed in distinct time periods (e.g., morning, afternoon, evening, bedtime). Accordingly, the blisters (206) are labeled by time period and date, for example, MM DD YYYY, period of the day.

In some implementations, the mobile device can communicate with the patient via, for example, a user interface of the mobile application. In some implementations, the caregiver or other party, can interact with the mobile application.

In some implementations, a hub or gateway can be communicatively coupled to one or more cloud servers via private or public communication networks, allowing communications between the various processing devices.

In some implementation, each one of the electronic cards (300) (or blister pack attachments (400) communicating with a hub can include unique serial numbers or identification tags, such as RFID tags, that can be associated with a respective patient.

Although the present invention has been described hereinabove by way of specific embodiments thereof, it can be modified, without departing from the spirit and nature of the subject invention defined in the appended claims.

The invention claimed is:

1. A blister pack system comprising:

a blister pack assembly comprising:

a blister sheet defining a plurality of spaced-apart blisters for receiving medication therein, a sealing sheet sealing the blister sheet, the sealing sheet comprising electric traces respectively associated with the blisters and ending in sheet connectors at or near an edge of the sealing sheet, the blisters being detachable or openable, whereby detaching or opening a blister breaks up a corresponding circuit formed by at least one of the electric traces associated with the blister, the sealing sheet comprising spaced apart alignment apertures proximate the sheet connectors; and blister pack attachment securable to the blister pack assembly, the blister pack attachment comprising:

an electronic card housing comprising aligning members protruding therefrom;

an electronic card received within the electronic card housing, the electronic card comprising electronic components including card connectors, and spaced-apart electronic card apertures; and a locking system configurable between a locked configuration and a releasing configuration, wherein in the locked configuration, the aligning members of the housing are inserted into the electronic card apertures and into the alignment apertures of the sealing sheet, the blister pack assembly and the electronic card being connected with the sheet connectors and the card connectors being aligned and in electronic communication, allowing the electronic components to detect whether a given blister has been detached from the blister pack assembly or opened;

wherein in the releasing configuration, the electronic card and the blister pack assembly are removable from the blister pack attachment, allowing the electronic card to be reused; and wherein the electronic components further comprise a wireless transceiver and a power module in electric communication with the wireless transceiver.

2. The blister pack system according to claim 1, wherein the electronic card comprises an electronic support having an electronic support aperture formed therein, the edge of the sealing sheet being insertable in the electronic support aperture with the sheet connectors extending past the electronic support aperture such that the sheet connectors and the card connectors can be electronically connected.

3. The blister pack system according to claim 2, wherein the electronic support further defines an electronic support first side comprising the electronic components, an electronic support second side, and an electronic support upper edge, the card connectors extending from the electronic support first side at or near the electronic support upper edge.

4. The blister pack system according to claim 2, wherein the card connectors are spaced-apart and provided in an alignment adjacent to the electronic support aperture.

5. The blister pack system according to claim 2, wherein the sheet connectors are spaced-apart and provided in an alignment which corresponds to the longitudinal alignment of the card connectors.

6. The blister pack system according to 1, further comprising a locking frame being coupled to the electronic card housing, the locking frame comprising a connectors compression section configured to apply pressure on both the sheet connectors and the card connectors when the locking system is configured in the locked configuration.

7. The blister pack system according to claim 6, further comprising a compressible strip configured to interface with the upper edge of the sealing sheet when being compressed by the connectors compression section and the electronic card housing when the locking system is configured in the locked configuration.

8. The blister pack system according to claim 7, wherein the compressible strip extends from the electronic card housing.

9. The blister pack system according to claim 6, wherein the electronic card housing defines a housing first side and a housing second side, the blister pack attachment further comprising a first arm extending from the connectors compression section and being securable with the housing first side.

10. The blister pack system according to claim 9, further comprising a second arm extending from the connectors compression section and being securable with the housing second side.

11. The blister pack system according to claim 10, wherein the electronic card housing defines a housing upper edge and the locking frame defines a locking frame longitudinal edge being pivotally coupled to the housing upper edge.

12. The blister pack system according to claim 11, wherein the first arm defines a first arm locking end, the blister pack attachment further comprising a first pinching finger extending from the first arm about the first arm locking end and being securable with the housing first side to provide the locking system in the locked configuration.

13. The blister pack system according to claim 12, wherein the second arm defines a second arm locking end opposite the locking frame longitudinal edge, the blister pack attachment further comprising a second pinching finger extending from the second arm about the second arm locking end and being securable with the housing second side to provide the locking system in the locked configuration.

14. The blister pack system according to claim 13, wherein the electronic card housing defines a housing outer surface, a housing inner surface opposite the housing outer surface and housing sidewalls joining the housing outer surface and the housing inner surface, each one of the first and the second pinching fingers comprising a housing sidewall interface perpendicularly extending from a surface of the locking frame for interfacing with one of the housing sidewalls when the locking system is configured in the locked configuration.

15. The blister pack system according to claim 14, wherein each one of the first and the second pinching fingers further comprises a housing outer surface interface perpendicularly extending from the housing sidewall interface for interfacing with the housing outer surface when the locking system is configured in the locked configuration.

16. The blister pack system according to claim 15, wherein the first arm and the second arm and/or the first pinching finger and the second pinching finger are made from a resilient material allowing the first arm and the second arm and/or the first pinching finger and the second pinching finger to deform when the locking system is provided between the releasing configuration and the locked configuration.

17. The blister pack system according to claim 16, wherein the blister sheet further comprises blister sheet apertures formed therein and configured to receive the aligning members of the housing therein, in the locked configuration.

18. The blister pack system according to claim 1, wherein the aligning members of the housing comprises an electronic card supporting member upwardly extending from housing inner surface, and a locking pin upwardly extending from the electronic card supporting member and being insertable within a respective one of the spaced-apart electronic card apertures to lock the electronic support with the electronic card housing.

* * * * *